US005782867A

United States Patent [19]

Shrock et al.

[11] Patent Number: 5,782,867

[45] Date of Patent: Jul. 21, 1998

[54] DIAPHRAGM SWITCH

[75] Inventors: Richard A. Shrock; Edward B. Shrock, both of Elgin, Ill.

[73] Assignee: JASB, Inc., Elgin, Ill.

[21] Appl. No.: 729,162

[22] Filed: Oct. 11, 1996

Related U.S. Application Data

[63] Continuation-in-part of Ser. No. 457,615, Jun. 1, 1995.

[51] Int. Cl.[6] ..... A61J 12/00; H01H 35/40

[52] U.S. Cl. ..... 606/234; 200/83 N

[58] Field of Search ..... 200/83 A, 83 N, 200/83 C, 83 R, 83 W, 83 Z, 81 H, 512, 515; 606/234–236

[56] References Cited

U.S. PATENT DOCUMENTS

| | | | |
|---|---|---|---|
| 4,554,919 | 11/1985 | Hubert . | |
| 4,586,621 | 5/1986 | Dahan . | |
| 4,726,376 | 2/1988 | Dahan . | |
| 4,768,510 | 9/1988 | Leung . | |
| 4,856,519 | 8/1989 | Teves . | |
| 5,109,864 | 5/1992 | Lu . | |
| 5,113,048 | 5/1992 | Lafferty | 200/83 Z |
| 5,292,335 | 3/1994 | Shin . | |

FOREIGN PATENT DOCUMENTS

| | | |
|---|---|---|
| 1188947 | 6/1985 | Canada . |
| 0185614 | 3/1990 | European Pat. Off. . |

*Primary Examiner*—Glenn K. Dawson

*Attorney, Agent, or Firm*—Wood, Phillips, VanSanten, Clark & Mortimer

[57] ABSTRACT

A diaphragm switch includes a housing having an interior space and a substrate in the housing supporting an electrical contact. A flexible membrane has opposite first and second surfaces, the first surface being electrically conductive. The membrane is mounted in the housing proximate the substrate with the first surface minutely spaced apart from the electrical contact. An activation pressure in the housing is communicated to the second surface of the membrane whereby deformation of the flexible membrane caused by the activation pressure closes the minute spacing between the electrically conductive first surface and the electrical contact, thereby completing an electrical circuit. A leakage path is operatively associated with the membrane between the first and second surfaces to equalize static pressure on both surfaces, whereby the flexible membrane is not deformed and the circuit is not complete in the absence of the activation pressure.

22 Claims, 4 Drawing Sheets

DIAPHRAGM SWITCH

CROSS-REFERENCE

This application is a continuation-in-part of application Ser. No. 08/457,615 filed Jun. 1, 1995.

FIELD OF THE INVENTION

This invention relates to a diaphragm switch and, more particularly, to an improved diaphragm switch which activates under dynamic conditions and deactivates under static conditions.

BACKGROUND OF THE INVENTION

Electronic products often require a low cost activation method using a switch that when activated remains activated under static conditions. Others, particularly battery operated toys, should activate the toy only in response to a dynamic change. As an example, a battery powered musical toy in a child's toy box might play continuously if pressed by an adjacent toy. This will drain a battery very quickly and may prove an annoyance if the toy plays a sound continuously. The same can occur when the products are stored, shipped, or sometimes during normal usage. As a result, a toy on the store shelf might have a drained battery prior to sale.

Most electronic toys that require a low cost remote activation use some form of switch located some distance from the electronic circuits. This can be costly. Additional wires and soldering are required.

One example of a product that might use such a switch is a musical pacifier. A pacifier, as its name suggests, is often used by parents to pacify an infant. The typical pacifier includes a plastic mouthpiece having a faceguard. A flexible nipple is secured to the faceguard. A handle or the like is often provided for the infant or parent to grasp the pacifier. The mouthpiece includes a casing or housing for an electronic programmed circuit which is switchable to produce an audible sound, such as a musical tune. In one known form the switch comprises a diaphragm switch overlying an opening between the nipple and the housing. As is known with diaphragm operation, a pressure differential causes movement of the diaphragm. The pressure differential is produced when the infant sucks on the nipple, causing an increased pressure on the nipple side of the diaphragm resulting in movement of the diaphragm to close an electrical switch. The switch closure triggers the programmed circuit to produce a musical tune played through a miniature speaker.

An important concern with parents is cleanliness of an infant's pacifier. It is not unusual for the pacifier to fall on the floor and thus become contaminated, or to be picked up by other persons which might transfer bacteria to the nipple. A pacifier is typically sterilized by placing it in boiling water or into a dishwasher.

With a musical pacifier, additional concerns exist with respect to sterilization due to possible damage to the electronic components. Either the pacifier must be made watertight and immersion proof or be disposable. If the pacifier is watertight and immersion proof, then it can be placed in water, however, a diaphragm type switch may rupture if a large differential pressure develops across it. This can occur if the air on one side of the diaphragm switch heats up faster than the air on the other side when the pacifier is boiled, sterilized, or washed in a dishwasher.

Likewise, a change in atmospheric pressure or altitude will compress or expand the nipple and place a bias on the diaphragm switch. The bias consists of a change in the distance of the conductive material on the diaphragm switch from the contacts on the printed circuit board. The switch may then be harder to activate by the infant or the switch may be activated inadvertently for long periods of time, leading to premature battery failure.

The present invention is directed to overcoming one or more of the problems discussed above in a novel and simple manner.

SUMMARY OF THE INVENTION

In accordance with the invention there is provided a diaphragm switch that activates under dynamic conditions and deactivates under static conditions.

Broadly, there is disclosed herein a diaphragm switch comprising a housing having an interior space and a substrate associated with the housing supporting an electrical contact. A flexible membrane has opposite first and second surfaces, the first surface being electrically conductive. Means mount the membrane in the housing proximate the substrate with the first surface minutely spaced apart from the electrical contact. Means are operatively associated with the housing for communicating an activation pressure to the second surface of the membrane whereby deformation of the flexible membrane caused by the activation pressure closes the minute spacing between the electrically conductive first surface and the electrical contact, thereby completing an electrical circuit. Leakage means are operatively associated with the membrane between the first and second surfaces to equalize static pressure on both surfaces, whereby the flexible membrane is not deformed and the circuit is not complete in the absence of the activation pressure.

It is a feature of the invention that the first surface is defined by a conductive fabric layer. The fabric is laminated to a thin urethane foam backing layer with a doublesided tape. The conductive fabric comprises a woven polyester fabric having a coating of nickel on copper. The flexible membrane is approximately 0.019 inches thick.

It is another feature of the invention that the substrate comprises a circuit board carrying the electrical contact thereon. The circuit board includes an insulating layer surrounding the contact and the membrane first surface rests on the insulating layer to provide the minute spacing. The insulating layer overlays a portion of the contact so that the minute spacing is controlled by thickness of the insulating layer.

It is yet another feature of the invention that the flexible membrane comprises a urethane backing layer seated in the housing and leakage means is provided by a porous seal between the urethane backing and the housing.

There is disclosed in accordance with another aspect of the invention a diaphragm switch actuated apparatus comprising a housing including a deformable bladder and defining an interior space. A switch actuated sound generating circuit in the housing controllably reproduces audio signals and has a pair of electrical contacts. A flexible membrane has opposite first and second surfaces, the first surface being electrically conductive. Means mount the membrane in the housing proximate the circuit, with the first surface minutely spaced apart from the electrical contacts so that an activation pressure on the second surface of the membrane caused by deformation of the bladder deforms the flexible membrane to close the minute spacing between the electrically conductive first surface and the electrical contacts, thereby completing an electrical circuit to actuate the sound generating circuit. Leakage means operatively associated with the membrane between the first and second surfaces equalize static pressure on both surfaces, whereby the flexible membrane is not deformed and the electrical circuit is not completed in the absence of the activation pressure.

More particularly, the diaphragm switch consists of a conductive diaphragm in the form of a flexible membrane and an electronic circuit board in an interior space which develops an actuation pressure. The diaphragm has a first side which is electrically conductive. The first side is minutely spaced from a set of contacts on the electronic circuit board. The minute spacing between the electronic circuit board contacts and the first side of the diaphragm is achieved by adding an insulating layer of epoxy to the printed circuit board. To insure sufficient spacing between the contacts and the conductive diaphragm, the epoxy is selectively applied on top of the contact area with the central area of the contacts uncovered. A second side of the diaphragm is exposed in the interior space. The interior space is used to develop an activation pressure. This pressure deforms the conductive diaphragm in the direction of the contacts. When the pressure is sufficiently large the conductive diaphragm closes the minute spacing, thereby completing the circuit. The activation pressure is the pressure difference between the first and second sides of the diaphragm. Either a gain in pressure on the second side or a loss in pressure on the first side will deform the diaphragm in the direction of the contacts.

The diaphragm is laminated with three layers. The first layer is a thin, flexible layer of conductive cloth. The second is a thin, flexible layer of slightly porous foam. The two layers are laminated together using a flexible non-porous adhesive for the middle layer. The second layer, which is foam, forms a slightly porous seal to the interior space. This slightly porous seal allows any pressure difference between the first and second sides to equalize with time.

Further features and advantages of the invention will be readily apparent from the specification and from the drawing.

DETAILED DESCRIPTION OF THE INVENTION

Figure 1:
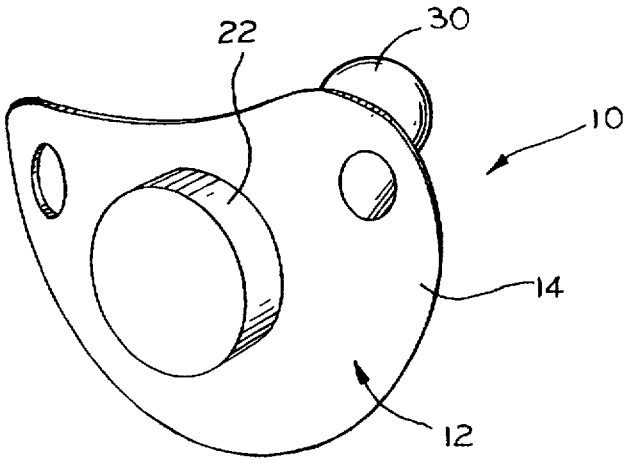
FIG. 1 is a perspective view of a musical pacifier including a diaphragm switch according to the invention.
Figure 2:
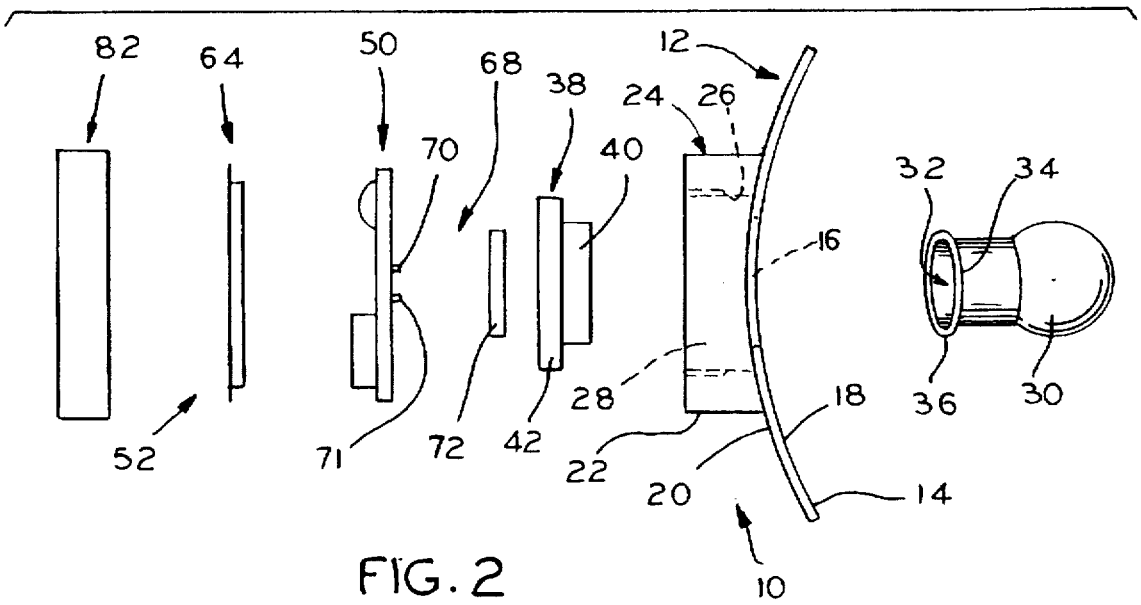
FIG. 2 is an exploded plan view of the pacifier of FIG. 1.

Referring to the drawings and more particularly FIGS. 1 and 2, there is shown generally at 10 a musical pacifier having a diaphragm switch according to the present invention.

The pacifier 10 includes a mouthpiece 12. The mouthpiece 12 has a faceguard 14 with a central opening 16. The faceguard 14 is of a conventional shape for pacifier faceguards having an inner surface 18 configured to be complementary to the face of an infant. Integrally connected to an outer surface 20 of the faceguard 14 is a generally cylindrical wall 22 to provide a housing 24. The wall 22 is coaxial with the opening 16. The cylindrical wall 22 includes an inner cylindrical surface 26 defining an interior space 28.

A bladder in the form of a nipple 30 of conventional shape has an interior space 32 accessible via an opening 34. An enlarged lip 36 is provided at the opening 34. As is conventional, the nipple 30 is of a flexible rubber-like material deformable due to sucking action of an infant. The nipple 30 is received in the mouthpiece opening 16. The lip 36 is of a size larger than the opening 16 to be loosely retained therein. With the nipple 30 mounted in the mouthpiece 12, the nipple interior space 32 is in communication with the housing interior space 28 through the central opening 16.

A plug 38 secures the nipple 30 to the mouthpiece 12. Particularly, the plug 38 includes a head 40 of a size and shape corresponding generally to the nipple open end 34 to be received therein. Thus, the head 40 sandwiches the nipple 30 in the opening 16. The nipple 30 provides a seal between the plug 38 and faceguard 14. Owing to this construction, the plug 38 floats within the housing 24, along an axial center line of the housing 24.

Figure 3B:
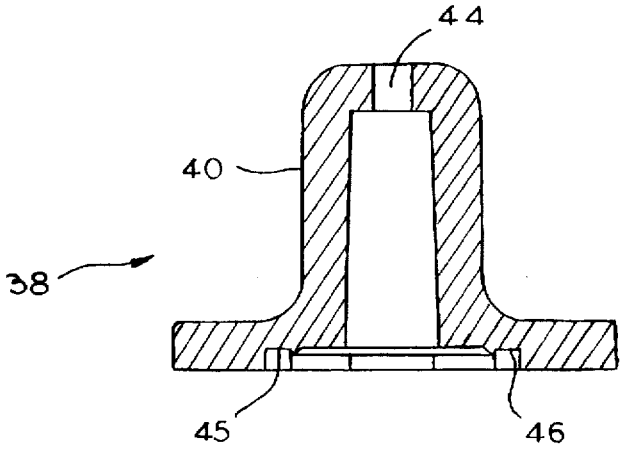
FIG. 3B is a sectional view taken along the line 3B—3B of FIG. 3.
Figure 3A:
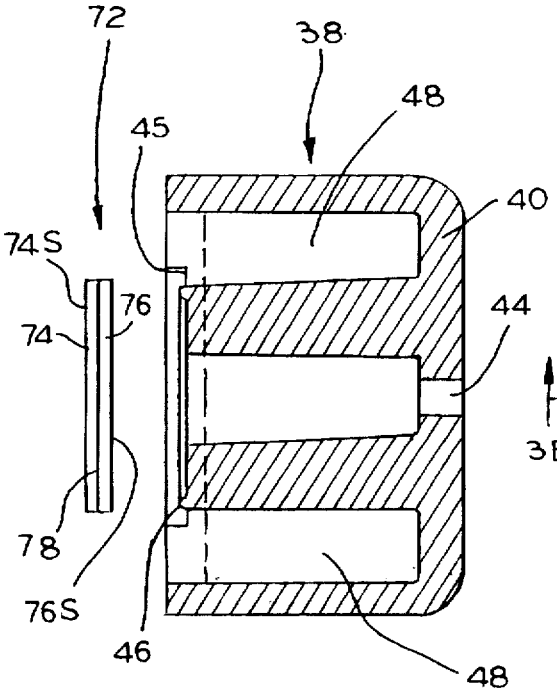
FIG. 3A is a sectional view taken along the line A—A of FIG. 3.
Figure 3:
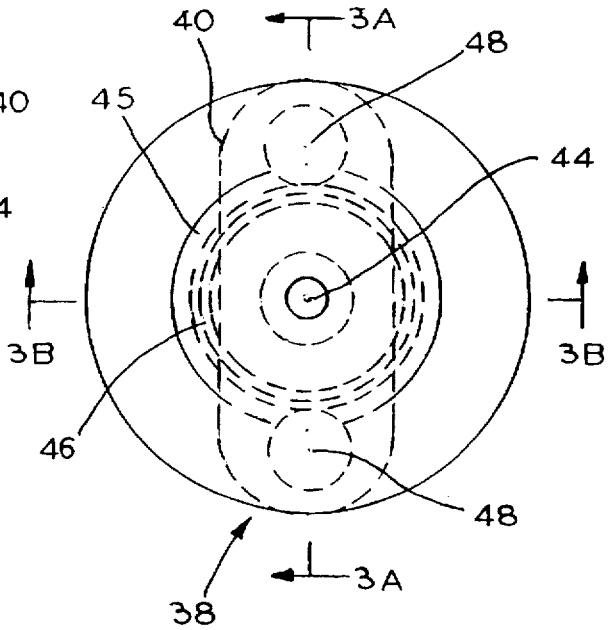
FIG. 3 is an end view of a plug and membrane of the pacifier of FIG. 1.

As particularly shown in FIG. 3, the plug 38 includes an axial opening 44. With the plug 38 mounting the nipple 30 to the mouthpiece 12, the opening 44 defines a narrowed air passage from the nipple interior space 32 to the housing interior space 28. The plug 38 includes a partial circular bore 45 coaxial with the opening 44 and having an interior circular ridge 46. Outer openings 48 save plastic and prevent cave-in while cooling.

Figure 5:
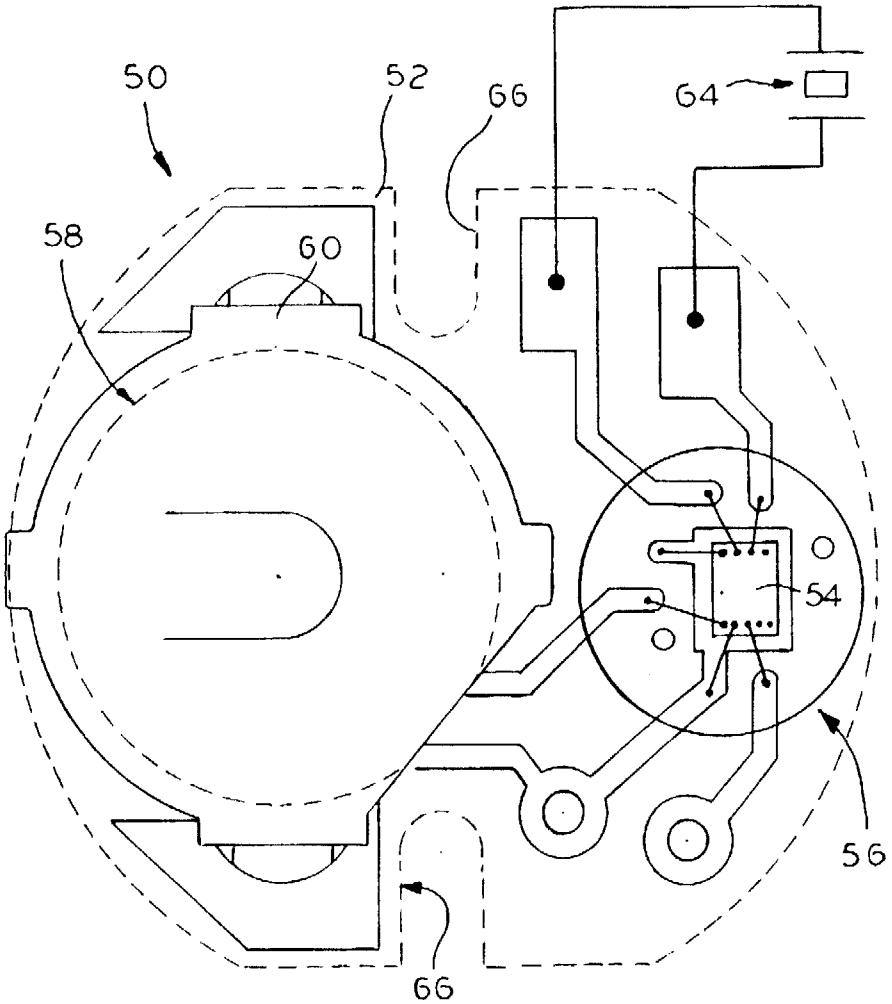
FIG. 5 is a top plan view of the printed circuit board of FIG. 4.
Figure 4:
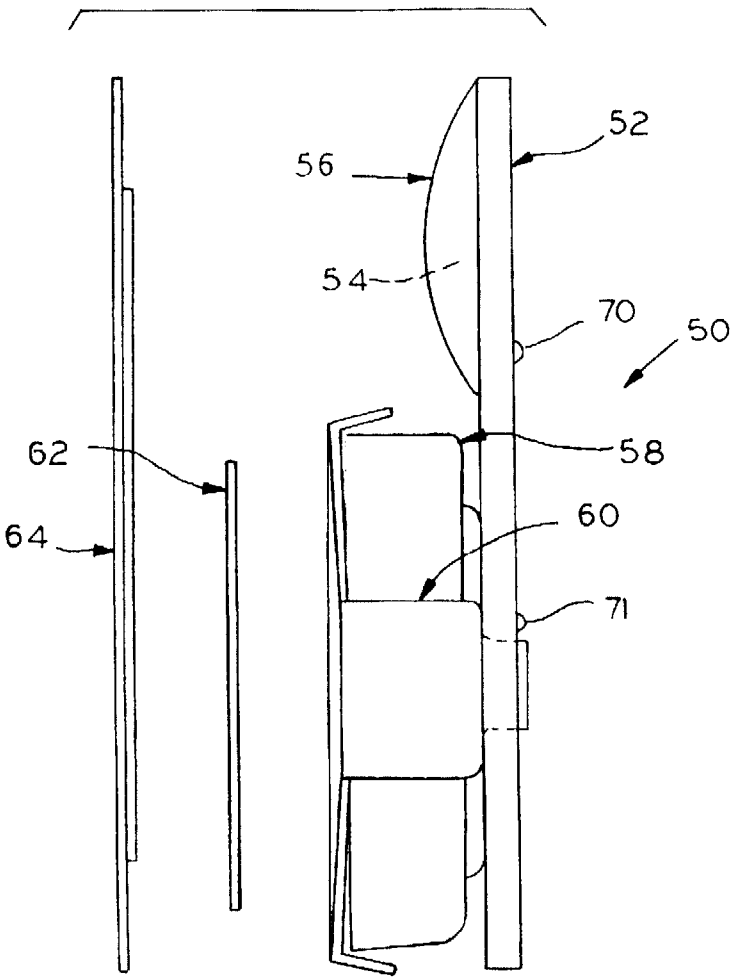
FIG. 4 is a partial exploded view illustrating details of an electronic sound generating circuit of the pacifier of FIG. 1.

Referring also to FIGS. 4 and 5, a switch-actuated sound generating circuit 50 is disposed in the housing 24 for controllably reproducing audio signals. The circuit 50 comprises a printed circuit board 52 supporting a programmed integrated circuit 54 sealed with a glob of epoxy 56. Power is provided by a battery 58 secured to the circuit board 52 with a conventional battery clip 60. A strip of double-sided tape 62 secures a piezo speaker 64 to the battery clip 60 and electrically insulates the two from each other. The speaker 64 is electrically connected to the integrated circuit 54 as generally illustrated in FIG. 5.

The switch-actuated sound generating circuit 50 is electrically actuated by a pressure sensitive diaphragm switch 68 according to the invention. The diaphragm switch 68 comprises fixed electrical contacts, represented at 70 and 71 on the bottom of the circuit board 52, and a diaphragm in the form of a flexible membrane 72. The membrane 72 is of laminated construction and is generally circular in shape. The membrane 72 is sandwiched between the circuit board 52 and the plug 38. The membrane has an outer diameter similar to an inner diameter of the plug partial bore 45 to be received therein. The partial bore 45 maintains the membrane 72 in a central axial position.

The flexible membrane 72 includes a first layer 74 and second layer 76 secured by a middle layer 78. The first layer 74 defines a first surface 74S. The second layer 76 defines an opposite second surface 76S. The first layer is a conductive fabric. Particularly, it comprises a woven polyester fabric onto which a thin metal coating of nickel on copper has been applied. A suitable conductive fabric may comprise Flectron fabric sold by Monsanto Company. The second layer 76 comprises a thin urethane or foam rubber backing layer. The middle layer 78 comprises a thin double-sided tape between the foam layer 76 and conductive fabric layer 74. The total thickness of the membrane 72 is 0.019inches nominal. In the illustrated embodiment of the invention, the membrane 72 is a circular disk of 9/32" diameter.

Figure 6:
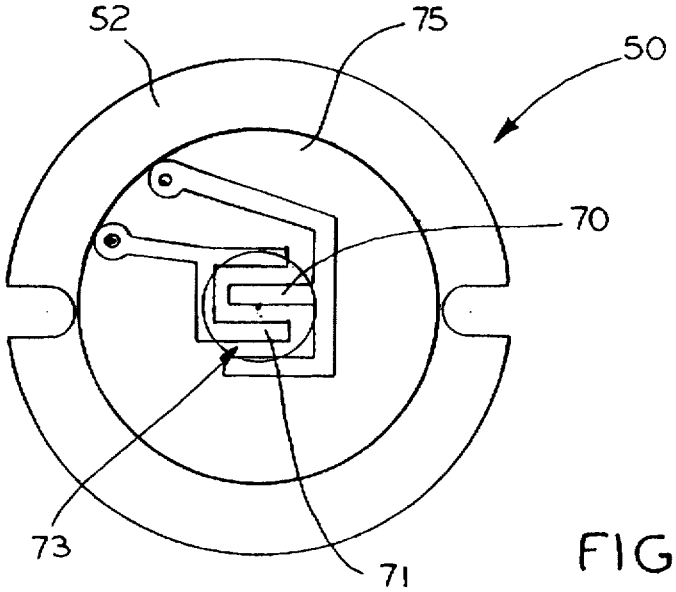
FIG. 6 is a bottom plan view of the printed circuit board of FIG. 4 illustrating electrical contacts that form part of the diaphragm switch.

Referring to FIG. 6, the bottom of the circuit board 52 is illustrated. The contact 70 comprises a U-shaped conductive trace connected to a lead on the board 52. The contact 71 also comprises a U-shaped conductive trace also connected to a lead on the board 52. The U-shaped portions of the contacts 70 and 72 are oppositely facing and interleaved, as shown. A thin layer of epoxy 75 in the form of a ring partially covers the circuit board 52 except for a circular area represented at 73 so that only a portion of the contacts 70 and 71 are exposed. The epoxy layer 75 elevates the membrane 72 to minutely space the membrane 72 from the contacts 70 and 71 to prevent inadvertent actuation of the contacts 70 and 71 by the membrane 72. Particularly, the epoxy layer 75 is in the range of 0.0005" to 0.003" thick, with a preferred thickness of 0.0015". Thus the membrane is normally spaced 0.0015" from the contacts 70 and 71 as shown in FIG. 7.

A cap 82 is received on the housing 24. The cap 82 maintains the speaker 64, circuit board 52, membrane 72 and plug 38 within the housing 24. Particularly, the cap 82 and mouthpiece 12 are of polycarbonate construction. The cap 82 is sonically welded onto the cylindrical wall 22 to provide an airtight and watertight seal. By fusing the cap 82 to the wall 22, the plug 38 is effectively held in place in a desired central position. Likewise, the nipple 30 acts as a gasket between the plug 38 and the mouthpiece 12 to provide a further airtight and watertight construction.

The particular operation and programming of the sound generating circuit 50 is not critical to the claimed invention. The circuit may be generally similar in operation to that described in U. S. Pat. No. 4,554,919 and is operable to reproduce audio signals, such as a musical tune, for a period of time after contact is made between the contacts 70 and 71 by the membrane 72.

Figure 7:
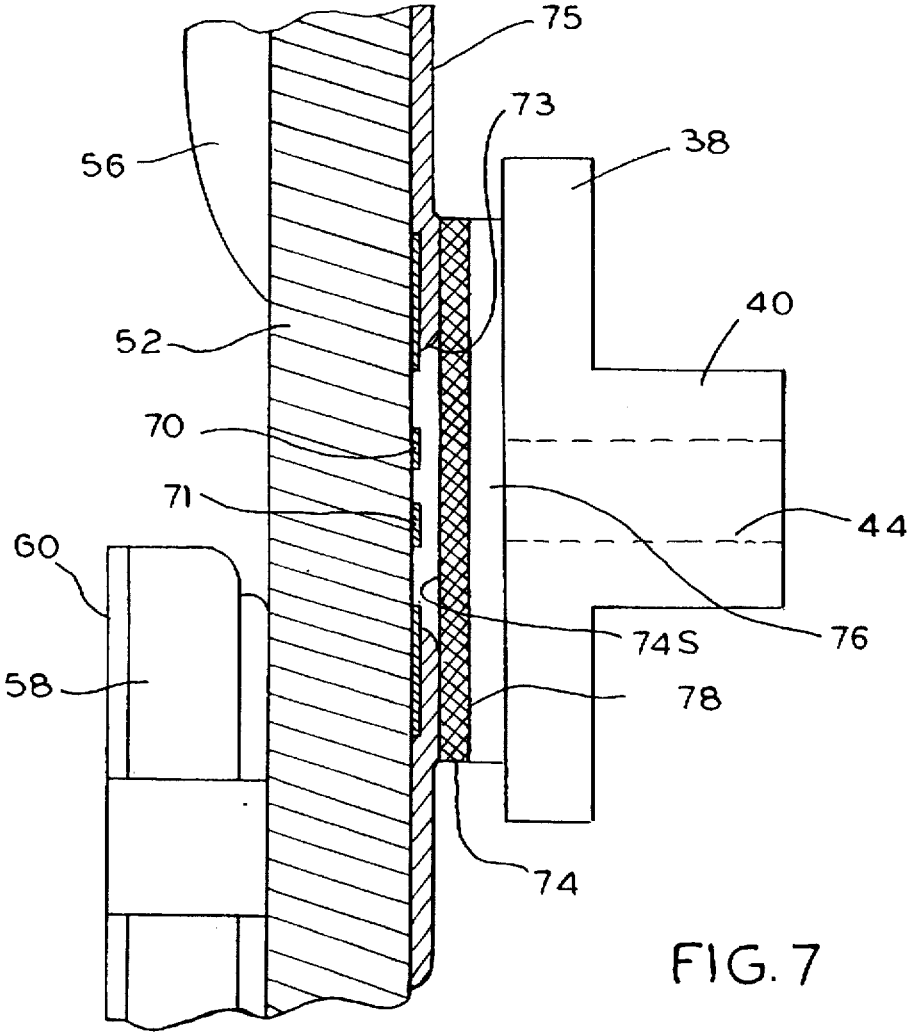
FIG. 7 is a side partial view, partially in section, illustrating the diaphragm switch in greater detail.

Normally, i.e., in the shelf state, the membrane 72 generally closes the air passage 44 so that the membrane 72 is minutely spaced from the contacts 70 and 71, as shown in FIG. 7. When the nipple 30 is collapsing, as by the infant sucking, a dynamic activation pressure change occurs in the nipple interior space 32 to force the membrane 72 to deform and close the minute spacing between the electrically conductive surface 74S and the contacts 70 and 71 thereby completing an electrical circuit to actuate the sound generating circuit 50 to play a musical tune on the speaker 64. The pressure difference across the diaphragm switch 68 is relieved slowly. If the nipple 30 is held collapsed for an extended period, the pressure difference across the diaphragm switch 68 is relieved and the membrane 72 then returns to its normal position. A similar equalizing action occurs again after the nipple 30 is released if held collapsed for an extended period.

The ridge 46 is used to create an air pressure "leaky seal". The seal area is short—just the area around the tip of the ridge 46. If there was not a ridge, the seal would be lengthened from the edge of the switch to the point where the chamber begins to slope downward. This could result in static pressure differences that might not equalize as quickly.

The ridge 46 also minimizes the force needed to sandwich the electronic module, switch, and the plug 38 together.

With the use of the flexible membrane 72 as described, an ultrasensitive pacifier results in which less biting force is required on the nipple 30. The pacifier 10 is also less expensive to produce. No expensive molds are needed to make the switch. The switches are lower in cost and simpler to manufacture. Also, the pacifier, owing to use of the described membrane 72, is easier to assemble and more consistent. The construction results in higher manufacturing yield in addition to the labor and material cost savings.

The sensitivity of the diaphragm switch 68 resulting from use of the flexible membrane 72 is due to various factors. The surface conductivity is magnitudes higher than that of carbon impregnated switch materials that are typically used in other diaphragm switches due to the first layer having a metallized coating which is an excellent conductor. This means that less surface area of the layer 74 is needed to bridge the contacts 70 and 71 in order to activate the sound generating circuit 50. Therefore, less air pressure and less squeezing on the nipple 30 is required for activation. Because the material of the metal fabric layer 74 has high conductivity, activation is consistent. The foam rubber backing layer has low density and is flexible. Therefore, less pressure is required to move the membrane 72 against the switch contacts 70 and 71. Also, the metallized fabric layer 74 has surface porosity being that it is a fabric. This allows more air to escape from the space between the membrane 72 and the circuit board 52, allowing the membrane 72 to be pressed closer to the printed circuit board 52 during activation. Air trapped between the membrane 72 and the printed circuit board 52 may escape around the edges of the membrane 72. This prevents an air bubble from becoming trapped, which might prevent activation of the sound generating circuit 50. The membrane 72 is physically closer to the printed circuit board 52 than with switches in other musical pacifiers. Therefore, less movement of the membrane 72 is required to make contact with the switch contacts 70 and 71.

Pressure differences across the membrane 72 are acclimated without any special processing of the membrane due to the nature of the foam backing layer 76. It is very easily compressed and therefore does not provide a tight seal when the pacifier is assembled. Air can "bleed by" the ridge 46 in either direction. At the same time, quick pressure changes across the membrane, such as from a baby sucking the nipple 30, are enough to activate the switch 68 even though there may be some "bleed by" across the ridge 46. Slow pressure changes across the membrane 72, such as altitude changes or atmospheric pressure changes, are not enough to activate the switch 68. Instead, these changes are acclimated. Large pressure changes across the membrane 72, such as may develop when the pacifier is placed in boiling water, do not damage the switch 68 due to this "bleed by".

The membrane 72 is made using inexpensive laminating and die cutting tools run on automatic laminating and automatic die cutting equipment. Rolls of urethane foam on a paper carrier, double-sided tape and the conductive fabric layer are fed into the laminator, which squeezes them together and places the combined laminate on a fourth roll. The fourth roll is later fed into a rotary die cutter where razor-sharp dies are used to cut the circular shape. The excess is removed and discarded, leaving the circular switch membranes on the paper carrier which is then placed onto another roll. The switches are easily peeled off of this carrier as they are needed.

Because the pacifier 10 is of watertight and immersion proof construction, the electronic circuitry need not be removed if the pacifier 10 is immersed in water, such as for boiling, dishwashing or sterilization. The use of the foam rubber layer 76 prevents damage from a large differential pressure across the membrane 72 such as might occur during boiling, dishwashing or sterilization. Moreover, the foam rubber layer 76 prevents switch bias due to changes in ambient pressure and temperature. This is accomplished as the foam rubber layer 76 acts as a slow bypass path from one side of the membrane 72 to the other. A large pressure developing on one side of the membrane is relieved to the other side, preventing a large differential pressure from developing under static conditions. Likewise, the "bleed by" acclimates any change in atmospheric pressure, temperature or altitude, preventing a bias from forming on the membrane 72. A bias on the membrane 72 could make activation by the infant more difficult, or the membrane 72 could be activated inadvertently for long periods of time, leading to premature battery failure.

The drawings and description relate to use of the diaphragm switch 68 in connection with a musical pacifier 10. However, as will be apparent, the diaphragm switch 68 according to the invention can be used in numerous applications and function similarly to that disclosed herein. For example, the diaphragm switch can be used to actuate various apparatus including a deformable bladder defining an interior space and which creates an activation pressure. For example, in addition to the pacifier 10 disclosed herein, a diaphragm switch 68 could be used with a similar circuit on other baby toys, such as a teether or squeeze toy. With a teether, an infant could chew or bite on an appropriate bladder which communicates a pressure change to the diaphragm switch. In essence, such a teether is much like the disclosed nipple, although of different physical configuration. Likewise, a squeeze toy could include a hollow bladder internally to the toy, such as a stuffed animal. When the particular portion of the stuffed animal is pressed, much as with a nipple, the collapsing of the bladder produces an activation pressure which is communicated via a hose or other passage to activate a diaphragm switch. In the illustrated embodiment of the invention this can be accomplished simply by connecting a hose or tube between the nipple 30 and the plug passage 44. As is apparent, the particular physical configuration can be altered as necessary to the particular applications.

Other, non-toy, applications are possible. For example, the diaphragm switch could be used with a vibration-activated electronic chime or alarm. Such a product is mounted or suspended from a door, window, drawer or other object by a suction cup, squeeze bulb, membrane, or other pressure creating device. When the door or other object is moved, the mass of the product delays movement of the product slightly, causing the pressure-creating means to deform. When the pressure creating means deforms, it creates an activation pressure that is communicated to the diaphragm switch located on an electronic circuit board, which activates the chime or alarm.

The diaphragm switch could also be used in connection with a tornado detector to detect the drop in atmospheric pressure that occurs during an approaching tornado for purposes of a low-cost early warning system. The diaphragm switch would be used in a reverse fashion. Pressure would be developed in a closed, rigid housing for activating the switch. As the atmospheric pressure surrounding the product drops, the pressure within the rigid housing deflects the membrane toward the electronic printed circuit and activates a programmed sound, such as a siren. When the atmospheric pressure stabilizes, the diaphragm switch adjusts. Slow changes are handled as above without activating the circuit.

Thus, the invention broadly comprehends a diaphragm switch which activates under dynamic conditions and de-activates under static conditions.

I claim:

1. A diaphragm switch comprising:

a housing having an interior space;

a substrate in operative communication with said housing supporting an electrical contact;

a flexible membrane having opposite first and second surfaces, the first surface being electrically conductive;

means mounting said flexible membrane in said housing proximate the substrate with the first surface minutely spaced apart from the electrical contact;

means operatively associated with the housing for communicating an activation pressure to said second surface of the flexible membrane whereby deformation of the flexible membrane caused by the activation pressure closes the minute spacing between the electrically conductive first surface and the electrical contact thereby completing an electrical circuit; and said mounting means comprising leakage means operatively associated with said flexible for equalizing static pressure on both sides of said flexible membrane whereby the flexible membrane is not deformed and the circuit is not complete in the absence of the activation pressure.

2. The diaphragm switch of claim 1 wherein said first surface is defined by a conductive fabric.

3. The diaphragm switch of claim 1 wherein said flexible membrane comprises a conductive fabric laminated to a thin urethane foam backing.

4. The diaphragm switch of claim 3 wherein the conductive fabric is laminated to the backing with a double sided tape.

5. The diaphragm switch of claim 3 wherein the conductive fabric comprises a woven polyester fabric having a coating of nickel on copper.

6. The diaphragm switch of claim 1 wherein said flexible membrane is approximately 0.019" thick.

7. The diaphragm switch of claim 1 wherein said substrate comprises a circuit board carrying the electrical contact thereon.

8. The diaphragm switch of claim 7 wherein said circuit board includes an insulating layer surrounding said contact and said flexible membrane first surface rests on the insulating layer to provide the minute spacing.

9. The diaphragm switch of claim 8 wherein the insulating layer overlays a portion of the contact so that the minute spacing is controlled by thickness of the insulating layer.

10. The diaphragm switch of claim 1 wherein the flexible membrane comprises a urethane backing seated in the housing and said leakage means is provided by a porous seal between the urethane backing and the mounting means.

11. A diaphragm switch actuated apparatus comprising:

a housing including a deformable bladder and defining an interior space;

a switch actuated sound generating circuit in operative communication with said housing for controllably reproducing audio signals and having a pair of electrical contacts;

a flexible membrane having opposite first and second surfaces, the first surface being electrically conductive;

means mounting said flexible membrane in said housing proximate the circuit with the first surface minutely spaced apart from the electrical contacts so that an activation pressure on said second surface of the flexible membrane caused by deformation of the bladder deforms the flexible membrane to close the minute spacing between the electrically conductive first surface and the electrical contacts thereby completing an electrical circuit to actuate the sound generating circuit; and said mounting means comprising leakage means operatively associated with said flexible membrane for equalizing static pressure on both sides of said flexible membrane whereby the flexible membrane is not deformed and the electrical circuit is not complete in the absence of the activation pressure.

12. The diaphragm switch actuated apparatus of claim 11 wherein said first surface is defined by a conductive fabric.

13. The diaphragm switch actuated apparatus of claim 11 wherein said flexible membrane comprises a conductive fabric laminated to a thin urethane foam backing.

14. The diaphragm switch actuated apparatus of claim 13 wherein the conductive fabric is laminated to the backing with a double sided tape.

15. The diaphragm switch actuated apparatus of claim 13 wherein the conductive fabric comprises a woven polyester fabric having a coating of nickel on copper.

16. The diaphragm switch actuated apparatus of claim 11 wherein said flexible membrane is approximately 0.019" thick.

17. The diaphragm switch actuated apparatus of claim 11 wherein said substrate comprises a circuit board carrying the electrical contacts thereon.

18. The diaphragm switch actuated apparatus of claim 17 wherein said circuit board includes an insulating layer surrounding said contacts and said flexible membrane first surface rests on the insulating layer to provide the minute spacing.

19. The diaphragm switch actuated apparatus of claim 18 wherein the insulating layer overlays a portion of the contact so that the minute spacing is controlled by thickness of the insulating layer.

20. The diaphragm switch actuated apparatus of claim 11 wherein the flexible membrane comprises a urethane backing seated in the housing and said leakage means is provided by a porous seal between the urethane backing and the mounting means.

21. A diaphragm switch comprising:

a housing having an interior space;

a substrate in operative communication with said housing supporting an electrical contact;

a flexible membrane having opposite first and second surfaces, the first surface being electrically conductive;

means mounting said flexible membrane in said housing proximate the substrate with the first surface minutely spaced apart form the electrical contact;

means operatively associated with the housing for communicating an activation pressure to said second surface of the flexible membrane whereby deformation of the flexible membrane caused by the activation pressure closes the minute spacing between the electrically conductive first surface and the electrical contact thereby completing an electrical circuit; and leakage means operatively associated with said flexible membrane for equalizing static pressure on both sides of said flexible membrane whereby the flexible membrane is not deformed and the circuit is not complete in the absence of the activation pressure;

wherein said flexible membrane comprises a conductive fabric laminated to a thin urethane foam backing.

22. A diaphragm switch actuated apparatus comprising;

a housing including a deformable bladder and defining an interior space;

a switch actuated sound generating circuit in operative communication with said housing for controllably reproducing audio signals and having a pair of electrical contacts;

a flexible membrane having opposite first and second surfaces, the first surface being electrically conductive;

means mounting said flexible membrane in said housing proximate the circuit with the first surface minutely spaced apart form the electrical contacts so that an activation pressure on said second surface of the flexible membrane caused by deformation of the bladder deforms the flexible membrane to close the minute spacing between the electrically conductive first surface and the electrical contacts thereby completing an electrical circuit to actuate the sound generating circuit; and leakage means operatively associated with said flexible membrane for equalizing static pressure on both sides of said flexible membrane whereby the flexible membrane is not deformed and the electrical circuit is not complete in the absence of the activation pressure;

wherein said flexible membrane comprises a conductive fabric laminated to a thin urethane foam backing.

* * * * *